US006827601B1

(12) United States Patent
Haeberle

(10) Patent No.: US 6,827,601 B1
(45) Date of Patent: Dec. 7, 2004

(54) CORD GUARD FOR A HOUSEHOLD APPLIANCE

(75) Inventor: Robert J. Haeberle, Glen Allen, VA (US)

(73) Assignee: Hamilton Beach/Proctor-Silex, Inc., Glen Allen, VA (US)

( * ) Notice: Subject to any disclaimer, the term of this patent is extended or adjusted under 35 U.S.C. 154(b) by 0 days.

(21) Appl. No.: 10/369,142

(22) Filed: Feb. 18, 2003

(51) Int. Cl.[7] ..... H01R 13/56
(52) U.S. Cl. ..... 439/447; 174/135
(58) Field of Search ..... 439/447–448, 439/445–446; 174/135

(56) References Cited

U.S. PATENT DOCUMENTS

| | | | | |
|---|---|---|---|---|
| 3,093,432 A | | 6/1963 | King | 439/447 |
| 3,395,244 A | * | 7/1968 | Koehler | 174/135 |
| 3,497,608 A | | 2/1970 | Elliott et al. | 174/135 |
| 4,203,004 A | | 5/1980 | Cox | 174/135 |
| D302,883 S | | 8/1989 | Baldacci | |
| 5,170,016 A | | 12/1992 | Liu et al. | 174/138 R |
| 5,300,732 A | | 4/1994 | Wambeke et al. | 174/92 |
| 5,451,171 A | | 9/1995 | Dickie | 439/447 |
| 5,768,808 A | | 6/1998 | Czerner et al. | 38/88 |
| 5,823,817 A | | 10/1998 | Pyle | 439/447 |
| D404,363 S | | 1/1999 | Pyle | |
| D430,371 S | | 8/2000 | Brady et al. | |
| 6,140,584 A | | 10/2000 | Baldissara | 174/68.3 |
| D439,564 S | | 3/2001 | Huang | |
| 6,265,668 B1 | | 7/2001 | Liu | 174/135 |
| 6,276,078 B1 | | 8/2001 | Beverly et al. | 38/90 |
| 6,309,229 B1 | | 10/2001 | Sinclair | 439/110 |
| 6,431,904 B1 | * | 8/2002 | Berelsman | 439/447 |

OTHER PUBLICATIONS

Photograph of cord guard assembled on a Black & Decker iron which came to applicant's attension prior to the filing of the instant application.

Copending design patent application No. 29/175,895 of Robert J. Haeberle filed Feb. 12, 2003.

* cited by examiner

*Primary Examiner*—Michael C. Zarroli
(74) *Attorney, Agent, or Firm*—Roger S. Dybvig

(57) ABSTRACT

A cord guard has a power cord confining tube formed from a pair of wall members each of which has a series of stepwise and spirally extending wall panels. The panels of one of the wall members intertwines with the panels of the other of the wall members and both horizontal and vertical gaps are located between adjacent panels. In use, the tube readily flexes to a limited extent as needed by a spreading apart of the panel section margins that form the horizontal gaps.

2 Claims, 2 Drawing Sheets

CORD GUARD FOR A HOUSEHOLD APPLIANCE

FIELD OF THE INVENTION

This invention relates to a cord guard for a household appliance. The cord guard is used to minimize stress on a power cord that might occur as a result of frequent movements of the appliance. Cord guards in accordance with this invention may advantageously be used for household irons and could be used for other appliances such as hair dryers, small vacuum sweepers.

INCORPORATION BY REFERENCE

The disclosures of the each of the following US patents are incorporated by reference herein.

Baldacci U.S. Pat. No. Des. 302,883

Brady et al. U.S. Pat. No. Des. 430,371

Pyle U.S. Pat. No. 5,823,817

Czerner et al. U.S. Pat. No. 5,768,808

Beverly et al. U.S. Pat. No. 6,276,078

BACKGROUND OF THE INVENTION

Repeated flexing of an appliance power cord often ultimately leads to failure of the power cord. Power cord failures can take various forms, such as broken insulating jackets, exposed bare wires, broken wires, and internal electrical shorts. Cord guards can substantially extend the number of times power cords can be flexed without failure.

The portion of a power cord closest to an appliance to which the cord is attached is the portion usually most subjected to being bent during operation of the appliance. This portion is also subjected to substantial bending stresses when the power cord is wrapped around the appliance for storage. For this reason, a cord guard typically comprises a first, relatively fixed, end connected to the appliance, a second, free end, and a flexible, tubular mid-section intermediate the two ends.

In general, a cord guard is designed to prevent extreme bending of a power cord so that the power cord extends along a path without sharp bends or kinks. Accordingly, the mid-section of the cord guard must have some flexibility to permit the power cord to bend to a limited extent but should be sufficiently stiff to resist being sharply bent so that the portion of the power cord within the cord guard also has no sharp bends.

Cord guards have been molded from thermoplastic elastomer (TPE) materials, such as Santoprene. However, TPE materials are more expensive than many other plastic materials and can be difficult to work with. Polypropylene, an inexpensive plastic material, has been used successfully for molding cord guards. However, polypropylene is a relative rigid material and there are occasions when greater flexibility is required than can be obtained satisfactorily with prior cord guard designs. Added flexibility could be obtained by making a cord guard with thinner, walls, but that could reduce the useful life of the cord guard. Therefore, it can be difficult to provide inexpensive cord guards which are both long lasting and adequately flexible, yet resistant to excessive flexing.

SUMMARY OF THE INVENTION

An object of this invention is to provide a new cord guard which can be highly flexible yet resistant to excessive bending, and have a satisfactory useful life.

A cord guard made in accordance with this comprises a one-piece molded, hollow plastic tubular member having a first, relatively fixed, end shaped to be connected to an appliance, a second, free end, and an intermediate, power cord-confining tube. The entire cord guard is hollow so that, when connected to an appliance, the appliance power cord extends therethrough. The plastic material used to produce the cord guard is relatively rigid but the power cord-confining tube is so formed as to provide adequate flexibility. Various thermoplastic materials could be used in molding the cord guard, provided they are relatively rigid but capable of flexing. Polypropylene is an excellent material for this purpose because it is readily available, readily worked with, and inexpensive.

The intermediate, power cord confining tube is formed from a pair of wall members each of which has a series of stepwise and spirally extending panels. The panels of one of the wall members intertwines with the panels of the other of the wall members and both horizontal and vertical gaps are located between adjacent panels. (As used herein, "horizontal" refers to a direction transverse to the longitudinal axis of the cord guard and "vertical" refers to a direction parallel to the longitudinal axis of the cord guard.) In use, the intermediate tube readily flexes to a limited extent as needed by a spreading apart of the panel section margins that form the horizontal gaps.

Other objects and advantages will become apparent from the following description and the accompanying drawings.

BRIEF DESCRIPTION OF THE DRAWINGS

FIGS. 1, 2 and 5–8 also show by broken lines a jacketed heater power cord that extends through the cord guard.

FIG. 2 is a perspective view of the cord guard of FIG. 1 as viewed from the top and one end thereof.

FIG. 5 is a side elevational view showing the cord guard curved in response to bending stresses applied in a first direction to the power cord.

FIG. 6 is an end elevational view showing the cord guard curved in response to bending stresses applied in a second direction to the power cord.

FIG. 7 is a perspective view of the cord guard, as viewed from one end and one side thereof, showing the cord guard curved in response to bending stresses applied in a third direction to the power cord.

FIG. 8 is a somewhat diagrammatic, fragmentary perspective view on an enlarged scale of a cord guard in accordance with this invention, with parts shown in section and parts shown by broken lines, as viewed from above, one end and one side thereof.

DETAILED DESCRIPTION

Figure 1:
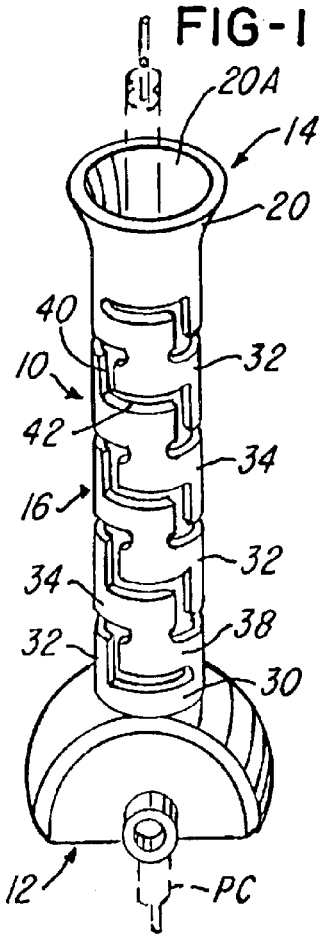
FIG. 1 is a perspective view of a cord guard in accordance with this invention as viewed from above and one side thereof.
Figure 2:
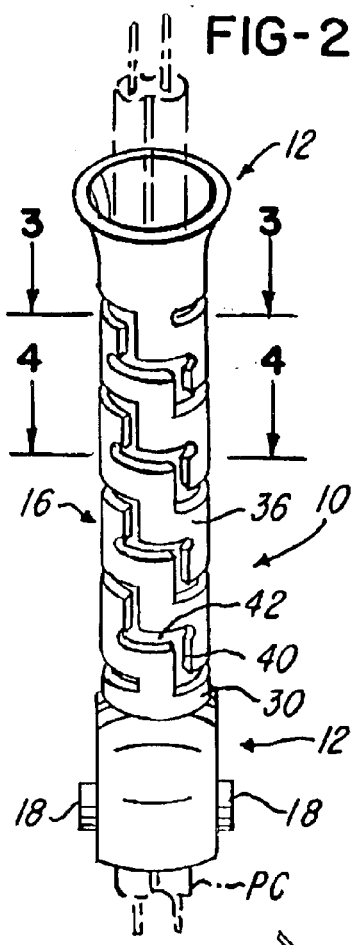
Figure 3:
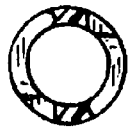
FIG. 3 is a transverse cross-sectional view of the cord guard as viewed in along line 3—3 of FIG. 2.
Figure 4:
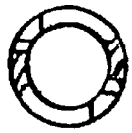
FIG. 4 is a transverse cross-sectional view of the cord guard as viewed in along line 4—4 of FIG. 2.

With reference to the drawings, a cord guard, generally designated 10, in accordance with this invention comprises a hollow, one-piece molded plastic tubular member having a relatively fixed, first end 12, a second, free end 14, and a mid-section comprising an intermediate, power cord-confining tube 16. The first end 12 has a pair of stub axles 18 by which the cord guard 10 is fixed to an appliance (not shown) having a power cord PC, but permit rotation of the cord guard 10 about the axis of the stub axles 18. The particular cord guard 10 illustrated in the drawings is used for a household pressing iron (not shown) and may be mounted for rotation about an axis extending longitudinally of the iron as shown in the above-mentioned U.S. Pat. Nos. Des. 430,371 and 6,276,078, for example. Optionally, the cord guard 10 could be mounted for rotation about an axis transverse to the longitudinal axis of the iron as shown in the above mentioned U.S. Pat. No. Des. 302,883. The design of the first end 12 could be different from that illustrated in the drawings for use with different arrangements for connecting the cord guard 10 to other appliances, including irons having swivelling cord guards, as shown in U.S. Pat. No. 5,768,808, for example.

The second, free end 16 of the cord guard 10 is formed as a bell 20 to provide a convexly curved inner surface 20A for engagement by the portion of the power cord PC extending through bell 20.

The cord guard 10 is molded in one piece from a plastic material which is sufficiently thick to be relatively rigid. Accordingly, the first end 12 and the second end 14 are quite rigid. One example of an acceptable cord guard in accordance with this invention for use with a two conductor, 18 gauge jacketed heater cord includes an intermediate, cord-confining tube having a wall thickness of approximately 0.060 inch and is molded from a polypropylene material obtained from Cisso of Tokyo, Japan, identified as Formula 4028, and has an inner diameter of 0.034 inch.

The intermediate tube 16 comprises a rigid tubular base 30 rigidly affixed to the first end 12 and a first, stepwise spiraling, tube wall portion 32 connected at one end to the base 30 and at its other end to the bell 20. The intermediate tube 16 further comprises a second stepwise spiraling, tube wall portion 34 that intertwines with the first tube wall 32. Each tube wall portion 32 and 34 has a series of rectangular wall panels 36 and 38., respectively, formed from end-to-end into circular sections, and arranged in a spiral and step manner around the longitudinal centerline of the cord guard 10 so that they progress stepwise from the base 30 to the bell 20. Except for the fact that the two wall portions 32 and 34 are each connected to the base 30 and the bell 20, the two wall portions 32 and 34 are mutually independent, and the wall panels 36 and 38 are separated from one another by arrays of vertical gaps 40 and horizontal gaps 42. Each panel 36 of the first wall portion 32 confronts a panel 38 of the second wall portion 34, these panels being spaced apart by 180°. Also each vertical gap 40 confronts a like vertical gap 180° degrees therefrom, and each horizontal gap 42 likewise confronts a horizontal gap 42 spaced 180° therefrom.

Figure 5:
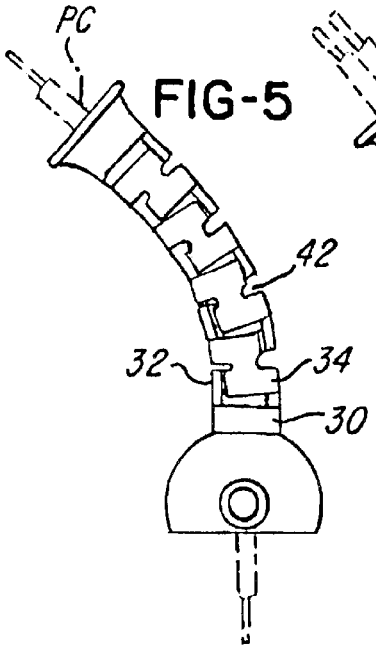
Figure 6:
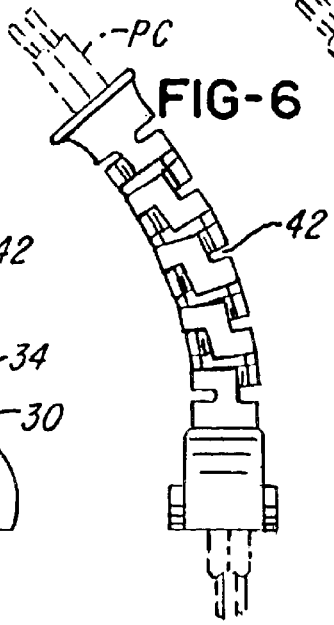
Figure 7:
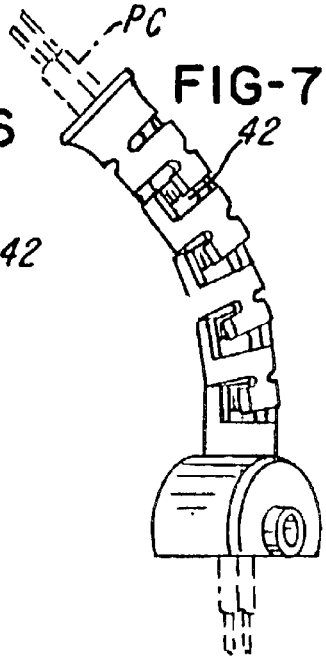
Figure 8:
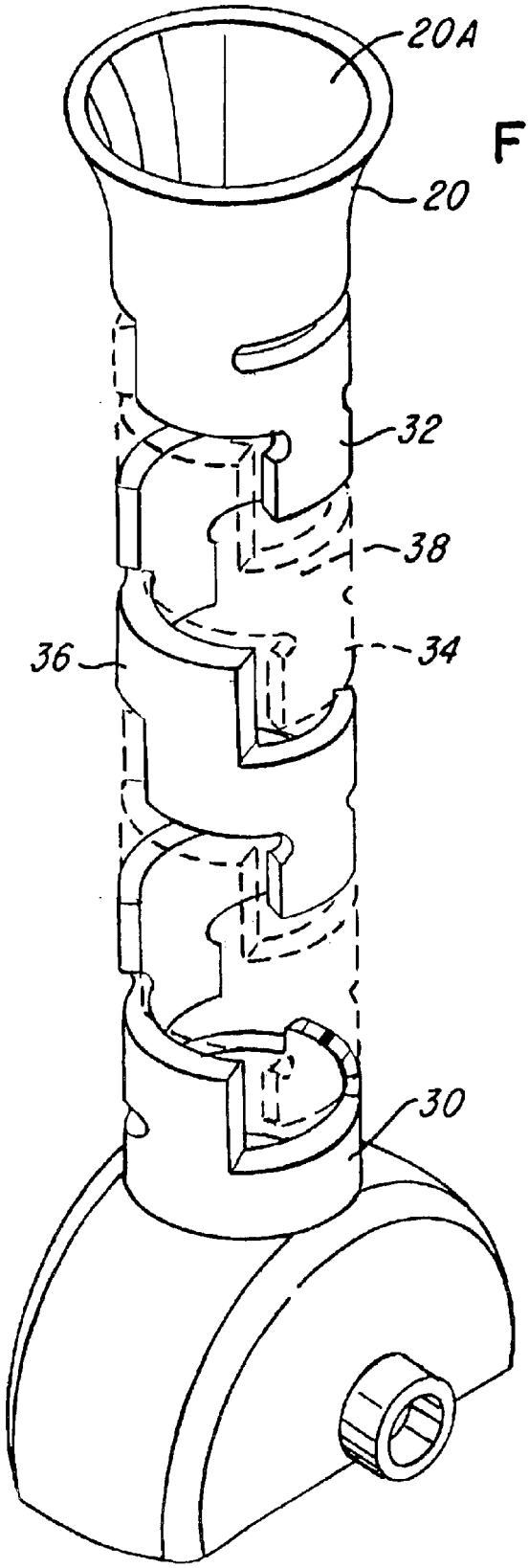

In view of the construction described above, and as illustrated in FIGS. 5, 6 and 7, the cord guard 10 can readily be bent as needed to accommodate bending stresses applied to the power cord PC, even though the cord guard 10 is made from a relatively rigid plastic material, because the wall panels forming the upper and lower boundaries of the horizontal gaps 42 readily spread apart, as shown on the right sides of FIGS. 5–7. On the other hand, the degree by which the horizontal gaps "open up" is limited the abutment of vertically aligned portions of the wall panels 36 and 38 with one another as shown on the left sides of FIGS. 5–7. As is evident from the foregoing and an inspection of FIGS. 5–7, the cord guard 10 of this invention readily permits limited bending of a power cord PC along the length of the cord guard 10, regardless of the direction of the bending stress applied to the power cord PC It will be understood that within the purview of the invention various changes may be made within the scope of the following claims.

I claim:

1. A cord guard for a household appliance comprising: a hollow tube having a first end shaped to be connected to a household appliance, a second, free end, and an intermediate, power cord-confining tube extending between said first and second ends;

said tube comprising a first wall member that is connected to said first end and to said second end, said first wall member comprising a series of stepwise and spirally extending panels;

said tube further comprising a second wall member that is connected to said first end and to said second end and that is otherwise independent of said first wall member, said second wall member comprising a series of stepwise and spirally extending panels intertwined with said first wall member so as to form said tube; and said panels of said second wall member being spaced from said panels of said first wall member so that an array of vertical gaps is formed in said tube between said panels and an array of horizontal gaps are formed in said tube between said panels so that said horizontal gaps can open up when bending stresses are applied to said power cord.

2. The cord guard of claim 1 wherein said cord guard is molded in one-piece from polypropylene.

* * * * *